US007502582B2

(12) United States Patent
Ng et al.

(10) Patent No.: US 7,502,582 B2
(45) Date of Patent: Mar. 10, 2009

(54) METHOD AND APPARATUS FOR PRINTING USING A TANDEM ELECTROSTATOGRAPHIC PRINTER

(75) Inventors: Yee S. Ng, Fairport, NY (US); Robert C. Logel, West Henrietta, NY (US)

(73) Assignee: Eastman Kodak Company, Rochester, NY (US)

( * ) Notice: Subject to any disclaimer, the term of this patent is extended or adjusted under 35 U.S.C. 154(b) by 354 days.

(21) Appl. No.: 11/021,119

(22) Filed: Dec. 22, 2004

(65) Prior Publication Data

US 2006/0133870 A1 Jun. 22, 2006

(51) Int. Cl.

| | |
|---|---|
| ***G03G 15/16*** | (2006.01) |
| ***G03G 15/20*** | (2006.01) |
| ***G03G 13/01*** | (2006.01) |
| ***G03G 13/06*** | (2006.01) |

(52) U.S. Cl. ..... 399/296; 399/341; 399/342; 430/45.4; 430/97

(58) Field of Classification Search ..... 399/341, 399/342, 320; 430/45.4, 97

See application file for complete search history.

(56) References Cited

U.S. PATENT DOCUMENTS

| | | | | |
|---|---|---|---|---|
| 5,234,783 | A * | 8/1993 | Ng | 430/45.53 |
| 5,258,256 | A * | 11/1993 | Aslam et al. | 430/124.1 |
| 5,807,652 | A * | 9/1998 | Kovacs | 430/45.31 |
| 5,866,288 | A * | 2/1999 | Ciccarelli et al. | 430/45.4 |
| 5,890,032 | A | 3/1999 | Aslam et al. | 399/69 |
| 6,678,493 | B2 * | 1/2004 | Maeyama et al. | 399/302 |
| 7,058,348 | B2 * | 6/2006 | Aslam et al. | 399/341 |
| 7,236,734 | B2 * | 6/2007 | Ng et al. | 399/341 |
| 2006/0110194 | A1 * | 5/2006 | Emmert et al. | 399/341 |

OTHER PUBLICATIONS

Dinesh Tyagi et al., "Enabling Expanded Color Gamut and In-line Coating Processes", IS&T's NIP20: 2004 International Conference on Digital Printing Technologies, pp. 135-138.

Yee Ng, "Gloss Uniformity Attributes for Reflection Images", IS&T's NIP17: International Conference on Digital Printing Technologies, pp. 718-722, 2001.

* cited by examiner

*Primary Examiner*—Vincent Q Nguyen
*Assistant Examiner*—Amy He
(74) *Attorney, Agent, or Firm*—Lawrence P. Kessler

(57) ABSTRACT

A tandem color electrostatographic printer apparatus has five or more color printing stations or modules for applying respective color separation toner images to a receiver member to form a pentachrome color image in a single pass. A fuser station fuses the pentachrome color image. A clear toner overcoat is then applied to the fused pentachrome toner image and enhanced glossing of the image is provided by a belt glosser to improve color gamut.

6 Claims, 9 Drawing Sheets

METHOD AND APPARATUS FOR PRINTING USING A TANDEM ELECTROSTATOGRAPHIC PRINTER

FIELD OF THE INVENTION

The invention relates to electrostatographic reproduction apparatus and methods and more particularly to color electrostatographic printers wherein color toner separation images are serially deposited upon a receiver member.

BACKGROUND OF THE INVENTION

In an electrophotographic modular printing machine of known type, such as for example the NexPress 2100 printer manufactured by NexPress Solutions, Inc., based in Rochester, N.Y., color toner images are made sequentially in a plurality of color imaging modules arranged in tandem, and the toner images are successively electrostatically transferred to a receiver sheet adhered to a transport web moved through the modules. Commercial machines of this type typically employ intermediate transfer members in the respective modules for the transfer to the receiver member of individual color separation toner images. However, the invention as described herein also contemplates the use of tandem electrostatographic printers that do not employ intermediate transfer members but rather transfer each color separation toner image directly to the receiver member.

Electrostatographic printers having a four-color capability are known to also provide a fifth toner depositing station for depositing for example, clear toner. The provision of a clear toner overcoat to a color print is desirable for providing protection of the print from fingerprints and reducing certain visual artifacts. However, a clear toner overcoat may add cost and may reduce color gamut of the print so it is desirable to provide for operator/user selection to determine whether or not a clear toner overcoat will be applied to the entire print. In U.S. Pat. No. 5,234,783, (Ng) it is noted that in lieu of providing a uniform layer of clear toner that a layer that varies inversely according to heights of the toner stack may be used instead as a compromise approach to even toner stack heights. As is known, the respective color toners are deposited one upon the other at respective locations on the receiver and the height of a respective color toner stack comprises the sum of the toner contributions of each respective color.

The invention recognizes that a four-color process provides a color gamut that is relatively limiting. The invention further recognizes that in using a tandem printer apparatus with five printing stations or modules one can unexpectedly still achieve an improved color gamut with application of clear toner in accordance with the teachings set forth herein.

SUMMARY OF THE INVENTION

The above and other aspects of the invention are realized in accordance with a first aspect of the invention wherein there is provided in a tandem color electrostatographic printer apparatus having five or more color printing stations for applying respective color separation toner images to a receiver member, a method of forming a pentachrome color image comprising passing a receiver member through the printer apparatus to serially deposit thereon in a single pass, at least five different colors which form various combinations of color at different pixel locations to form a pentachrome image thereon; a first fusing step of fusing the pentachrome image by passing the receiver member through a fuser station; passing the receiver member again through the printer apparatus and depositing a clear toner overcoat to the fused pentachrome toner image; a second fusing step of passing the receiver member with the clear toner overcoat and fused pentachrome toner image again through the fuser station to fix the clear toner overcoat to the receiver member.

In accordance with a second aspect of the invention, there is provided a system for printing color images comprising a tandem color electrostatographic printer apparatus having five or more color printing stations for applying respective color separation toner images to a receiver member passing therethrough in a single pass to form a pentachrome color image; a fusing station for fusing the pentachrome image; a clear toner overcoat printing station for applying a clear toner overcoat to the fused pentachrome toner image; and a belt glosser for providing enhanced gloss to the pentachrome color image having the clear toner overcoat.

In accordance with a third aspect of the invention, there is provided a method of printing to form colored images with improved color gamut and enhanced gloss, the method comprising forming a color print using five or more different color pigments which in combination form at least a pentachrome color image; depositing a clear toner overcoat to the at least pentachrome color image; and subjecting the clear toner overcoat and the at least pentachrome color image to a gloss enhancing process.

Other objects, advantages and novel features of the present invention will become more apparent from the following detailed description of the invention when considered in conjunction with the accompanying drawings.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings some elements have been removed and relative proportions depicted of the various disclosed elements may not be representative of the actual proportions, and some of the dimensions may be selectively exaggerated.

DETAILED DESCRIPTION OF THE INVENTION

Figure 1A:
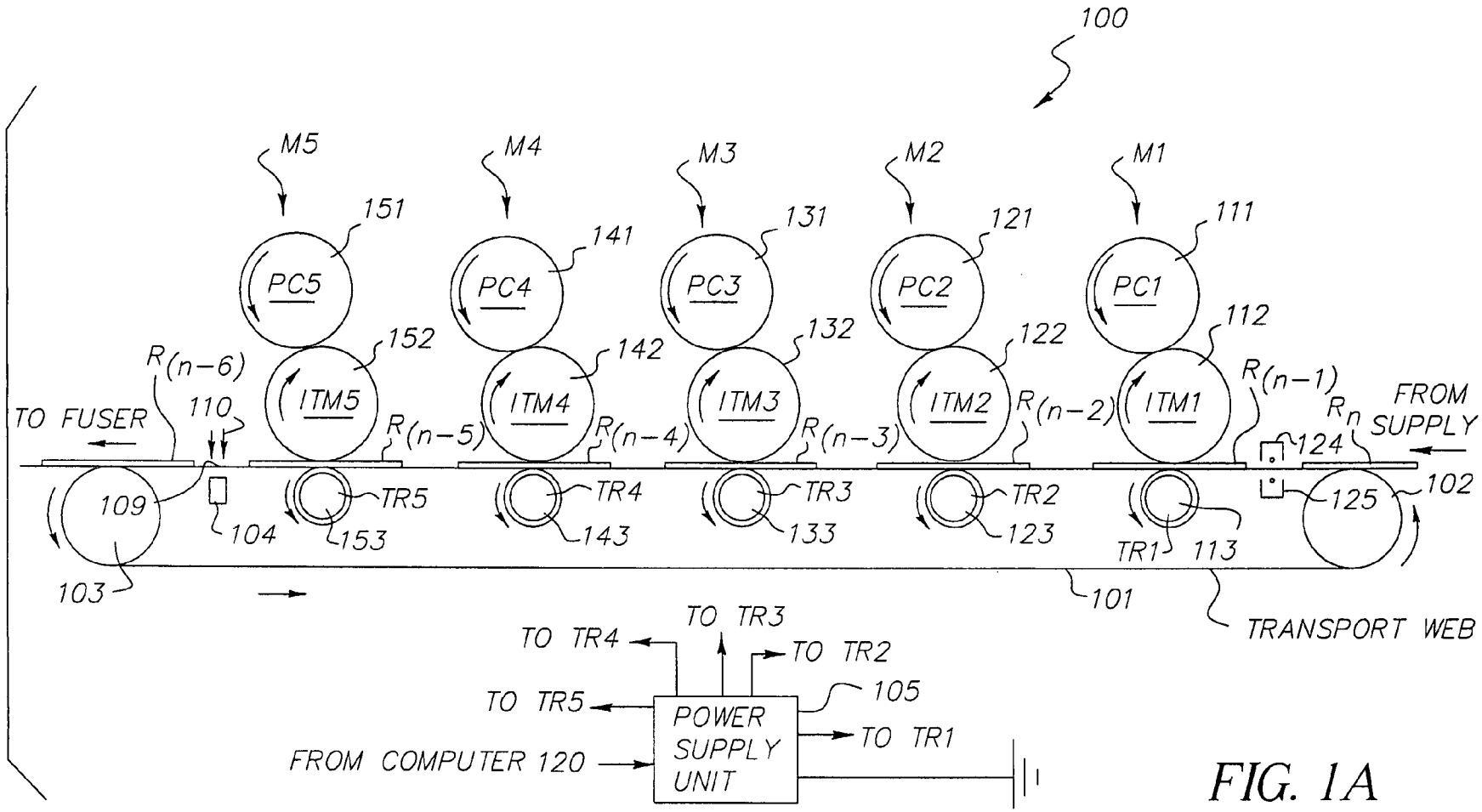
FIGS. 1A and 1B are a schematic of a tandem electrophotographic print engine or printer apparatus, having five color printing stations or modules that may be used in accordance with the invention to generate multicolor including pentachrome prints.
Figure 1B:
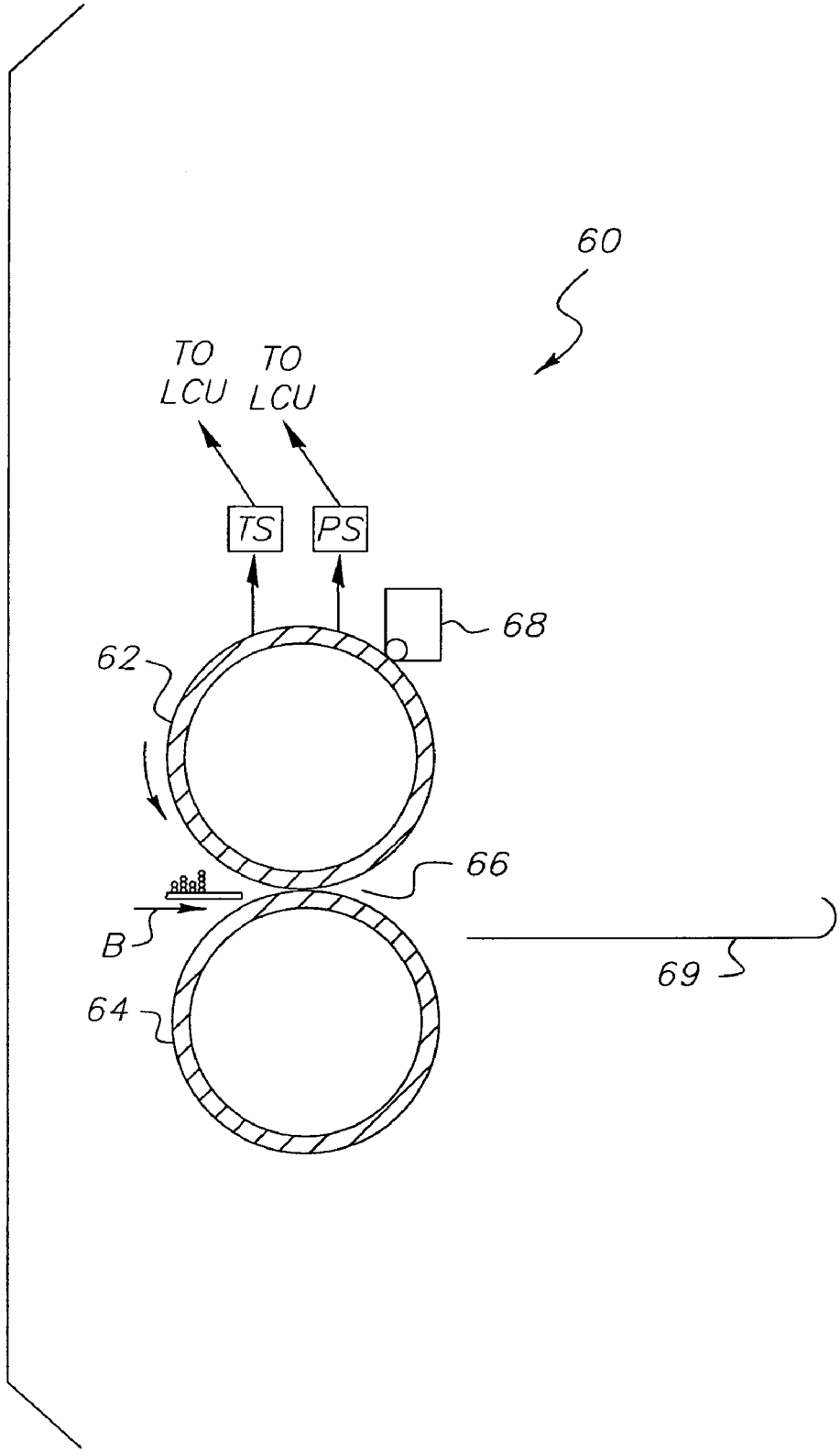

FIGS. 1A and 1B is an elevational view showing schematically portions of an electrophotographic print engine or printer apparatus suitable for printing of pentachrome images. Although one embodiment of the invention involves printing using an electrophotographic engine having five sets of single color image producing or printing stations or modules and arranged in a so-called tandem arrangement, the invention contemplates that more than five colors may be combined on a single receiver member. The invention further contemplates that the images formed therein may also be generated using electrographic writers and thus the apparatus of the invention is broadly referred to as an electrostatographic reproduction or printer apparatus.

In FIG. 1A there is shown an electrostatographic printer apparatus 100 having a number of tandemly arranged electrostatographic image forming modules or printing stations M1, M2, M3, M4, and M5. Each of the modules generates a single-color toner image for transfer to a receiver member successively moved through the modules. Each receiver member during a single pass through the five modules can have transferred in registration thereto up to five single-color toner images to form a pentachrome image. As used herein the term pentachrome implies that in an image formed on the receiver combinations of subsets of the five colors are combined to form other colors on the receiver at various locations on the receiver and that all five colors participate to form process colors in at least some of the subsets wherein each of the five colors may be combined with one more of the other colors at a particular location on the receiver to form a color different than the specific color toners combined at that location. In a particular embodiment, M1 forms black (K) toner color separation images, M2 forms yellow (Y) toner color separation images, M3 forms magenta (M) toner color separation images M4 forms cyan (C) toner color separation images. M5 may form one of red, blue, green or other fifth color separation image. It is well known that the four primary colors cyan, magenta, yellow and black may combine in various combinations of subsets thereof to form a representative spectrum of colors and having a respective gamut or range dependent upon the materials used and process used for forming the colors. However, in the electrostatographic printer apparatus of the invention a fifth color is added to improve the color gamut. In addition to adding to the color gamut, the fifth color may also be used as a specialty color toner image such as for making proprietary logos.

Receiver members are delivered from a paper supply unit (not shown) and transported through the modules. The receiver members are adhered (e.g., preferably electrostatically via coupled corona tack down chargers 124, 125) to an endless transport web 101 entrained and driven around rollers 102, 103. Alternatively, mechanical devices such as grippers, as is well-known, may be used to adhere the receiver members to the transport web 101. The receiver members are preferably passed through a paper conditioning unit (not shown) before entering the first module. Each of the modules includes a photoconductive imaging roller, an intermediate transfer member roller, and a transfer backup roller. Thus in module M1, a black color toner separation image can be created on the photoconductive imaging roller 111 (PC1), transferred to intermediate transfer member 112 (ITM1), and transferred again to a receiver sheet moving through a transfer station, which transfer station includes ITM1 forming a pressure nip with a transfer backup roller 113 (TR1). Similarly, modules M2, M3, M4, M5 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). A receiver member, Rn, arriving from the supply, is shown passing over roller 102 for subsequent entry into the transfer station of the first module, M I, in which the preceding receiver member R(n-1) is shown. Similarly, receiver members R(n-2), R(n-3), R(n-4), and R(n-5) are shown moving respectively through the transfer stations of modules M2, M3, M4, and M5. An unfused print formed on receiver member R(n-6) is moving as shown towards a fuser 60 for fusing the unfused print, the fuser being shown in FIG. 1B.

A power supply unit 105 provides individual transfer currents to the transfer backup rollers TR1, TR2, TR3, TR4, and TR5 respectively. A logic and control unit 230 (FIG. 2) includes one or more computers and in response to signals from various sensors associated with the apparatus provides timing and control signals to the respective components to provide control of the various components and process control parameters of the apparatus in accordance with well understood and known employments. A cleaning station (not shown) for cleaning web 101 is also typically provided to allow continued reuse thereof.

Figure 2:
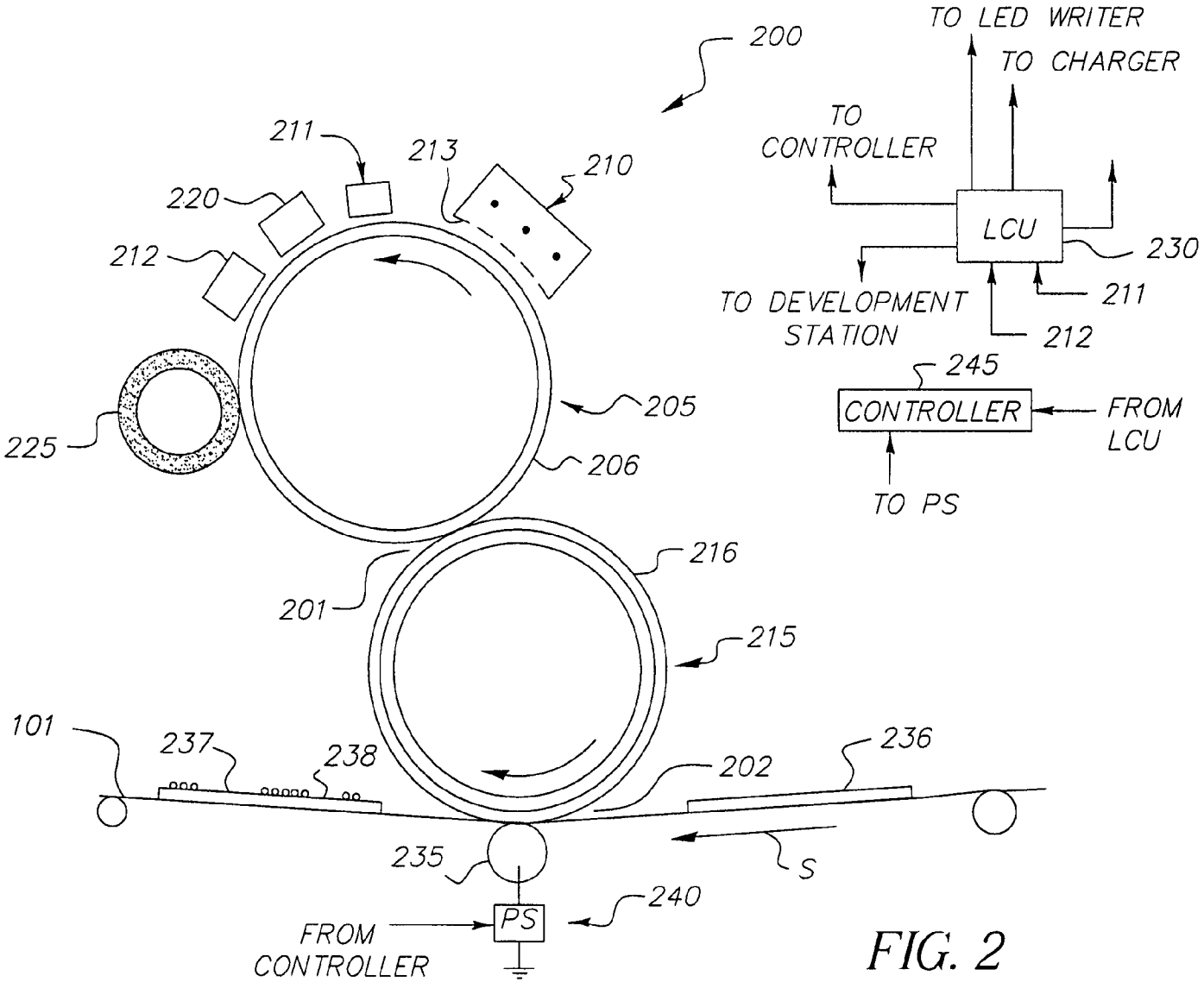
FIG. 2 is a schematic of a representative color printing station or module used in the print engine apparatus of FIG. 1A and showing additional details thereof.

With reference to FIG. 2 wherein a representative module is shown, each module of the printer apparatus includes a plurality of electrophotographic imaging subsystems for producing a single color toned image. Included in each module is a primary charging subsystem 210 for uniformly electrostatically charging a surface 206 of a photoconductive imaging member shown in the form of an imaging cylinder 205, an exposure subsystem 220 for image-wise modulating the uniform electrostatic charge by exposing the photoconductive imaging member to form a latent electrostatic color separation image in the respective color, a development station subsystem 225 for toning the image-wise exposed photoconductive imaging member with toner of the respective color, an intermediate transfer member 215 for transferring the respective color separation image from the photoconductive imaging member through a transfer nip 201 to the surface 216 of the intermediate transfer member 215 and from the intermediate transfer member to a receiver member (receiver member 236 shown prior to entry into the transfer nip and receiver 237 shown subsequent to transfer of the toned color separation image) which receives the respective toned color separation images in superposition to form a composite multicolor image thereon.

Subsequent to transfer of the respective color separation images, one from each of the respective printing subsystems or modules, the receiver member is advanced to a fusing subsystem to fuse the multicolor toner image to the receiver member. Additional members provided for control may be assembled about the various elements, such as for example a meter 211 for measuring the uniform electrostatic charge and a meter 212 for measuring the post-exposure surface potential within a patch area of a patch latent image formed from time to time in a non-image area on surface 206. Further details regarding the printer apparatus 100 are also provided in U.S. Pat. No. 6,608,641, the contents of which are incorporated herein by reference.

In an alternative embodiment the image-recording member 205 can alternatively have the form of an endless web and the intermediate transfer member 215 may also be an endless web although it is preferred to be a compliant roller of well-known type. The exposure device may comprise an LED writer or laser writer or other electro-optical or optical recording element. Charging device 210 can be any suitable device for producing uniform pre-exposure potential on photoconductive image recording member 205, the charging device including any type of corona charger or roller charger. A cleaning device may be associated with the surface 206 of the photoconductive image recording member and another cleaning device associated with the surface 216 of the intermediate transfer member after respective transfer of the toned images therefrom.

Associated with the modules 200 is the logic and control unit (LCU) 230, which receives input signals from the various sensors associated with the printer apparatus and sends control signals to the chargers 210, the LED writers 220 and the development stations 225 of the modules. Each module may also have its own respective controller coupled to the printer apparatus' main controller.

Subsequent to the transfer of the five color toner separation images in superposed relationship to each receiver member, the receiver member is then serially detacked from transport web 101 and sent in a direction indicated by arrow B to a fusing station to fuse or fix the dry toner images to the receiver member. The transport web is then reconditioned for reuse by cleaning and providing charge to both surfaces 124, 125 which neutralizes charge on the two surfaces of the transport web.

The electrostatic image is developed, preferably using the well-known discharged area development technique, by application of pigmented marking particles to the latent image bearing photoconductive drum by the respective development station 220 which development station preferably employs so-called "SPD"(Small Particle Development) developers. Each of development stations is respectively electrically biased by a suitable respective voltage to develop the respective latent image, which voltage may be supplied by a power supply or by individual power supplies (not illustrated). Preferably, the respective developer is a two component developer that includes toner marking particles and magnetic carrier particles. Each color development station has a particular color of pigmented toner marking particles associated respectively therewith for toning. Thus, each of the five modules creates a series of different color marking particle images on the respective photographic drum. Alternatively, the developer may comprise a single component developer. It is also contemplated that the color toners may each be associated with a liquid developer. As will be discussed further below, a clear toner development station may be substituted for one of the pigmented developer stations so as to operate in similar manner to that of the other modules which deposit pigmented toner, however the development station of the clear toner module has toner particles associated respectively therewith that are similar to the toner marking particles of the color development stations but without the pigmented material incorporated within the toner binder.

With reference to FIG. 1B, transport belt 101 transports the toner image carrying receiver members to a fusing or fixing assembly 60, which fixes the toner particles to the image substrate by the application of heat and pressure. More particularly, fusing station 60 includes a heated fusing roller 62 and an opposing pressure roller 64 that form a fusing nip 66 therebetween. Fusing station 60 also includes a release fluid application substation generally designated 68 that applies release fluid, such as, for example, silicone oil, to fusing roller 62.

The image substrate carrying the fused image is transported from the fusing station 60 along a path to either a remote output tray 69 or to a glossing station 70 (FIG. 3), or is returned to the image forming apparatus of FIG. 1A for the purpose to be described below. In the embodiment shown, glossing station 70 is a stand-alone and/or off-line unit. However, it is to be understood that glossing station 70 can be alternatively configured as an integral and/or built-in station of the printer apparatus 100.

Figure 3:
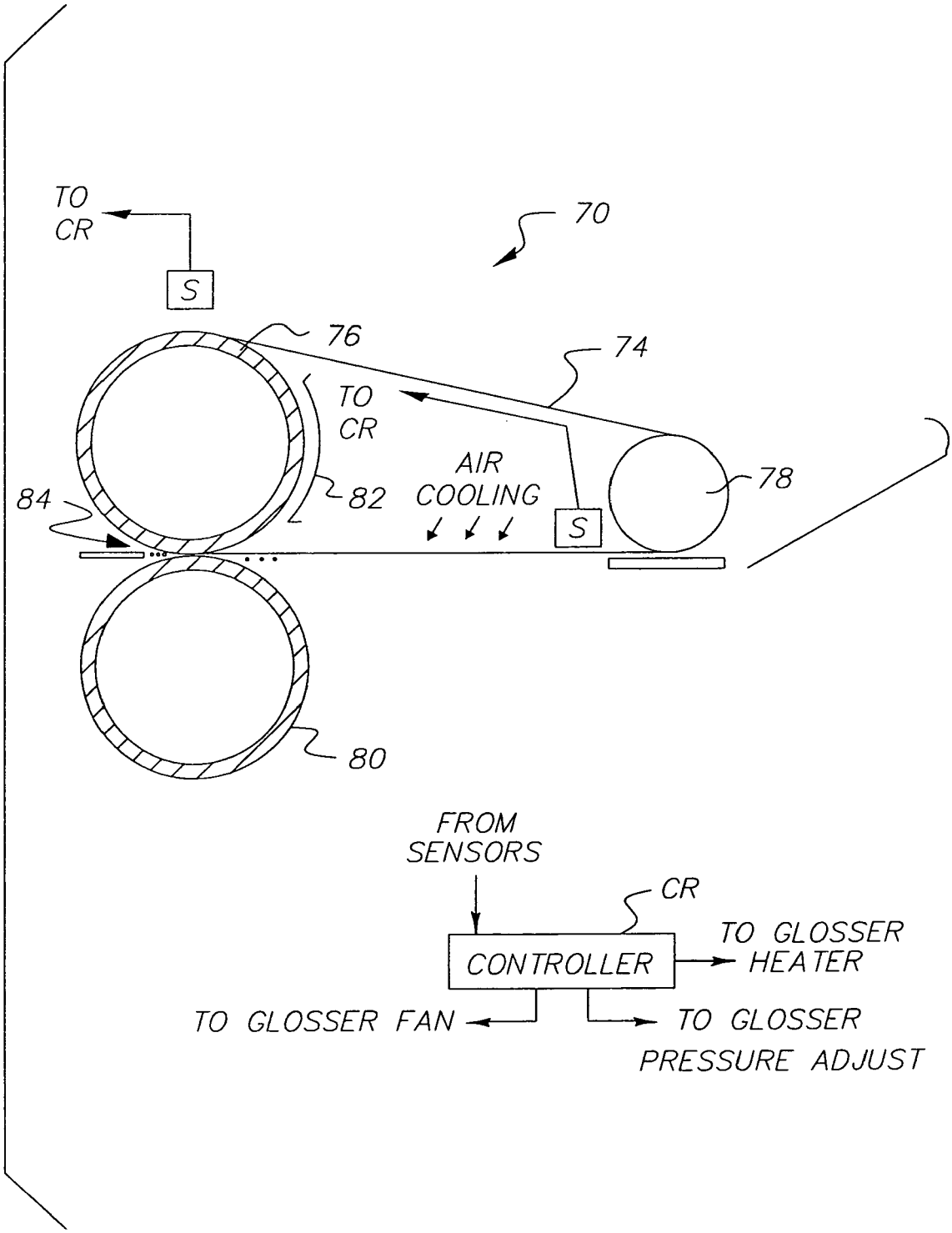
FIG. 3 is an illustration of a belt glosser apparatus that may be used in accordance with the invention.

With reference to FIG. 3 glossing station 70 includes a finishing belt 74, preferably formed of solgel, heated glossing roller 76, steering roller 78, pressure roller 80 and heat shield 82. Fusing belt 74 is entrained about glossing roller 76 and steering roller 78. Pressure roller 80 is opposed to, engages, and forms glossing nip 84 with heated glossing roller 76. Finishing belt 74 and the image substrate are cooled, such as, for example, by a flow of cooling air, upon exiting the nip 84 in order to reduce offset of the image to the finishing belt 74.

The logic and control unit (LCU) 230 includes a microprocessor and suitable tables and control software which is executable by the LCU. The control software is preferably stored in memory associated with the LCU. Sensors associated with the fusing and glossing stations provide appropriate signals to the LCU when the glosser is integrated with the printing apparatus. In any event the glosser can have separate controls providing control over temperature of the glossing roller and the downstream cooling of the belt and control of glossing nip pressure. In response to the sensors, the LCU issues command and control signals that adjust the heat and/or pressure within fusing nip 66 so as to reduce image artifacts which are attributable to and/or are the result of release fluid disposed upon and/or impregnating image substrate that is subsequently processed by/through glossing station 70, and otherwise generally nominalizes and/or optimizes the operating parameters of fusing station 60 for imaging substrates that are not subsequently processed by/through glossing station 70.

Figure 4:
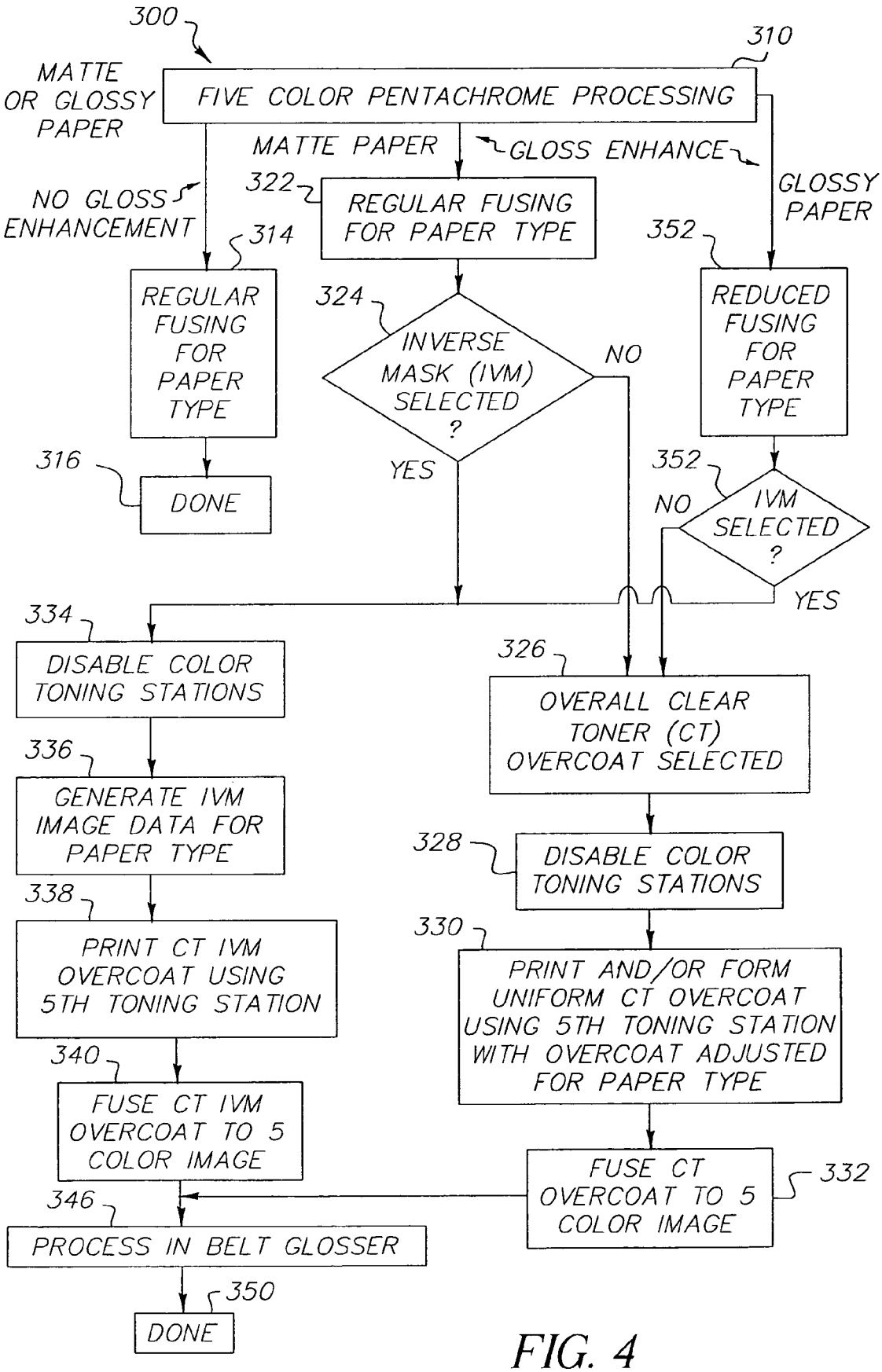
FIG. 4 is a flowchart illustrating operation of the apparatus of FIGS. 1A through 3 in accordance with the method of the invention.

With reference now to the flowchart 300 of FIG. 4, the assumption is that a five-color pentachrome image is to be formed on a receiver substrate, step 310. Through a single pass of the receiver member through the five color printing stations of printing apparatus 100, a receiver member in the form of a sheet, which may be of a paper, plastic, coated metal or a textile material receives a five color toner separation image formed thereon. Subsequent processing of the imaged receiver member is dependent upon whether or not the operator has input via an input device such as a computer terminal or other operator input device a request for subsequent glossing treatment. Where no glossing treatment or enhancement is requested regular fusing of the five-color image is performed, step 314, in accordance with the requirements of the receiver type. Typically, the parameters for nominal fusing of a typical receiver such as paper will be dependent upon the thickness and/or weight of the paper and its surface characteristics, such as manufactured gloss finish or matte finish. Subsequently, to fusing the image formed on the surface is complete, step 316, and no further processing of this receiver is required, except for perhaps forming another image on the opposite surface, i.e. duplex formation which is a standard practice and need not be discussed further herein.

Where glossing treatment is desired and assuming the receiver type is a matte paper, subsequent to five-color pentachrome processing in step 310, regular or nominal fusing for this paper type is provided for, step 322. The term regular or nominal fusing implies that similar conditions, e.g. temperature and pressure, for fusing a five color pentachrome image is provided for in this step as would be the case for fusing of a similar receiver sheet having a pentachrome image formed thereon and which is not to receive a glossing treatment.

In order to provide for a glossing treatment, the fifth toner station is modified such as by substituting a clear toner (CT) development station for the fifth color development station used in the formation of the pentachrome image. This development station may contain a coating that is automatically sensed by the printer apparatus so that processing conditions for using the clear toner are automatically established. The presence of the clear toner development station and the selection of a glossing treatment may also adjust the other pigmented toner printing stations to either disable the printers or development of toner at the first four printing stations or modules. The receiver sheet with the fused pentachrome image is then reinserted into the printer apparatus 100 such as by manual placement in a supply tray or by recirculating from an automatic feeder after fusing. The receiver sheet with the pentachrome image formed thereon is then carried by the transport web 101 past the four now inoperative color image forming modules M1-M4, step 334 or 328, to the fifth image forming module M5 which is now provided with clear toner.

Subsequent to the step of regular or nominal fusing, a determination is made as to whether or not an inverse mask (IVM) is selected, step 324. In lieu of providing a uniform application of clear toner to cover the entire image area, it is known to reduce the amount of clear toner by application of an inverse mask wherein one lays down more clear toner in areas that have less color toner coverage. In this IVM mode, balance is created in toner stack heights by providing relatively greater amounts of clear toner coverage to areas of an image having relatively lower amounts of color toner coverage and lesser amounts of clear toner coverage to areas of the image having relatively greater amounts of color toner coverage. In this regard, reference is made to U.S. Pat. No. 5,234,783. The controller of the printer apparatus may be programmed so as to be operative, for example by selection by the operator, to process the printing of a clear toner image in accordance with plural selectable modes so that some prints may be formed that are uniformly covered with clear toner and other prints may be formed with the clear toner deposited or printed in an IVM mode wherein balance is achieved in toner stack heights. Further details regarding the IVM mode are provided below.

Where the IVM is selected, the electro-optical recording element associated with the fifth image-forming module M5 is enabled in accordance with the information for establishing or printing an inverse mask in clear toner, step 338. Image data for the clear toner IVM is developed in accordance with paper type and the pixel by pixel locations as to where to apply the clear toner, step 336. Information regarding the pentachrome image is analyzed by a raster image processor (RIP see FIG. 5) associated with the logic and control unit to establish on a pixel by pixel basis as to where pigmented toner is located on the pentachrome printed receiver. Pixel locations having relatively large amounts of pigmented toner are designated as pixel locations to receive a corresponding lesser amount of clear toner so as to balance the overall height of pixel locations with combinations of pigmented toner and clear toner. Thus pixel locations having relatively low amounts of pigmented toner are provided with correspondingly greater amounts of clear toner, step 338. With reference to FIG. 6, there are illustrated exemplary graphs illustrating various inverse masks providing a relationship relative to amounts of clear toner to be deposited at pixel locations versus amounts of pigmented toner in the pentachrome image at the corresponding pixel location using one of the inverse masks illustrated.

Where an overall uniform clear toner overcoat is selected, step 326, the electro-optical recording element associated with the fifth image forming module M5 may be enabled in accordance with the information for establishing or printing an overall uniform coat in clear toner. Image data may be developed in accordance with paper type and the pixel by pixel locations suitably discharged or the electrostatic charge on the photoconductive surface of the imaging cylinder suitably reduced in the entire area where discharge area development is employed. More preferably, the electro-optical writer may be disabled and the uniform charger and clear toner development station electrical bias adjusted to provide a charge suitable for developing on the imaging cylinder an overall clear toner in the image area, by the clear toner development station, of a thickness suited for the receiver type, step 330.

After printing of the pentachrome image with clear toner either using the inverse mask mode or uniform clear toner application mode, the receiver with the image formed thereon is again moved into the fuser 66 to fuse the clear toner IVM image or uniform clear toner overcoat to the pentachrome image, steps 340 or 332. Thereafter the receiver with the fused CT overcoated pentachrome image is moved into the belt glosser, step 346. A fused and gloss enhanced pentachrome image is thus provided, step 350.

In the event that the receiver type employed is a glossy paper, five color pentachrome processed image formed by a single pass through the image forming modules M1-M5 is subjected to a reduced fusing processing, step 352, for this paper type wherein the fuser is adjusted to reduce temperature and/or pressure from a nominal setting established for this paper type for fusing a pentachrome image that is not to be subject to a further glossing step. The receiver sheet with the pentachrome image formed thereon is then reinserted into the printer apparatus 100 in accordance with the description provided above for the matte paper for a second pass through the apparatus wherein the image forming modules M1-M4 are once again disabled and the pigmented toner station of image forming module M5 provided with clear toner. A decision is made in step 352, as to whether or not an inverse mask or uniform clear toner overcoat is to be provided. The inverse mask preferably is adjusted for the type of paper as will be described below. Additionally, the amount of uniform clear toner overcoat provided where that mode is selected may also be adjusted for this type of glossy paper. The processing steps for processing of the printed inverse mask clear toner overcoat over the pentachrome image on the glossy paper, steps 334, 336, 338, 340, 346, and 350 are similar to that described for the matte paper embodiment. The parameters, however, for establishing the inverse mask, the fusing conditions and the conditions of the belt glosser are adjusted for this type of receiver. Herein, the processing steps 328, 330, 332, 346, and 350 will also be similar to that described for the matte paper embodiment with the amount of clear toner deposited, the fusing conditions and the conditions, of the belt glosser adjusted for this type of receiver.

As noted in commonly assigned U.S. application Ser. No. 10/933,986, filed on Sep. 3, 2004, a third mode may also be provided wherein back-transfer artifacts are reduced or eliminated without the need or expense of providing uniform coverage of clear toner to the print wherein a five color tandem printer is used to print fewer than five colors. In this third mode, the fifth station may be used during the first pass as a clear toner station to deposit more clear toner in relatively higher colored areas and less clear toner in areas having relatively lower amounts of colored toner.

With reference now to FIG. 3, image data for writing by the printer apparatus 500 may be processed by a raster image processor (RIP) 501 which may include a color separation screen generator or generators. The output of the RIP may be stored in frame or line buffers 502 for transmission of the color separation print data to each of the respective LED writers 506 K, Y, M, C and R (which stand for black, yellow, magenta, cyan, and red respectively and assuming that the fifth color is red). The RIP and/or color separation screen generator may be a part of the printer apparatus or remote therefrom. Image data processed by the RIP may be obtained from a color document scanner or a digital camera or generated by a computer or from a memory or network which typically includes image data representing a continuous image that needs to be reprocessed into halftone image data in order to be adequately represented by the printer. The RIP may perform image processing processes including color correction, etc. in order to obtain the desired color print. Color image data is separated into the respective colors and converted by the RIP to halftone dot image data in the respective color using threshold matrices, which comprise desired screen angles and screen rulings. The RIP may be a suitably programmed computer and/or logic devices and is adapted to employ stored or generated threshold matrices and templates for processing separated color image data into rendered image data in the form of halftone information suitable for printing.

Figure 5:
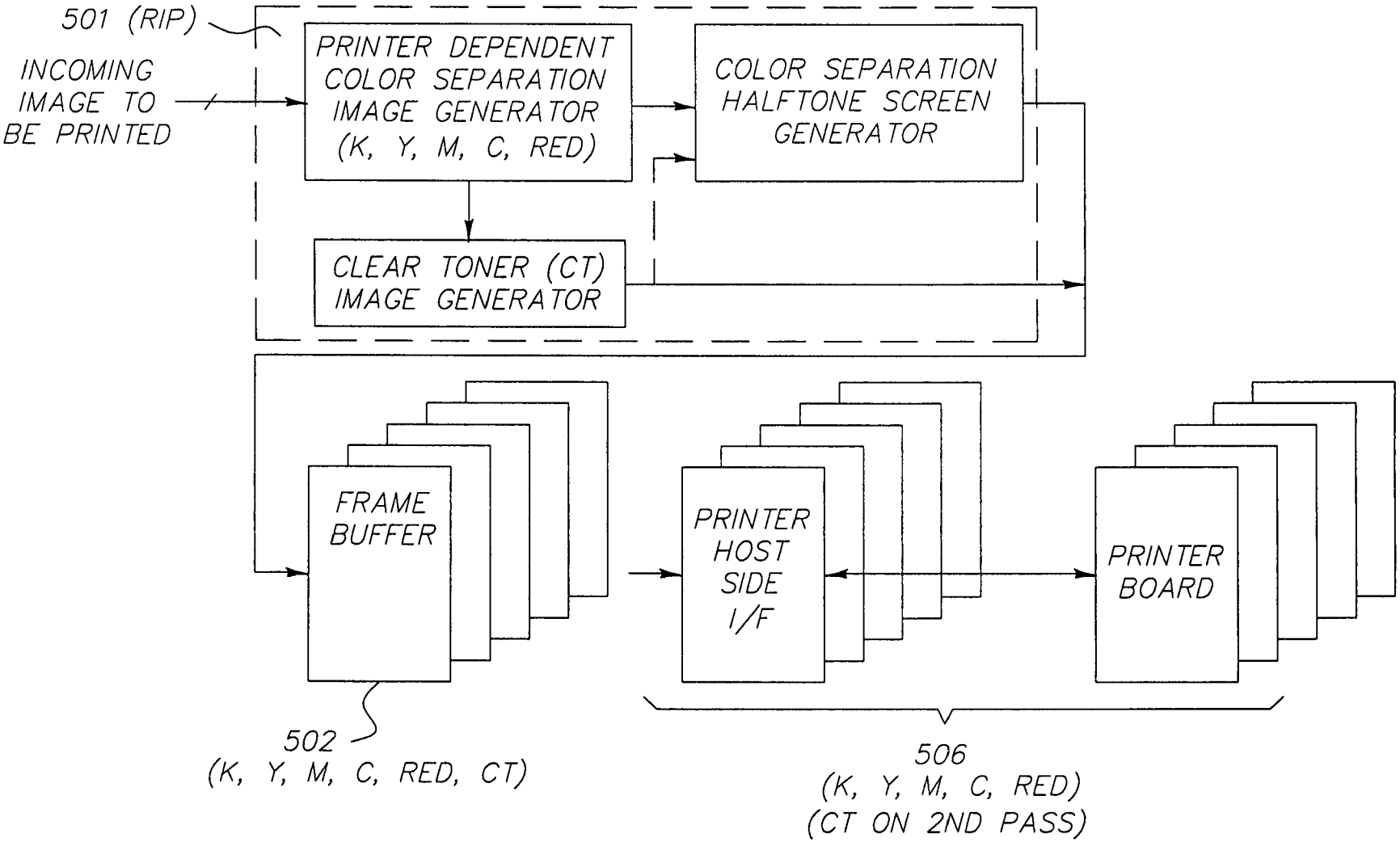
FIG. 5 is a schematic of an image processing system for providing image data to color and clear toner printing stations of the apparatus FIGS. 1A and 1B in accordance with the invention.
Figure 6:
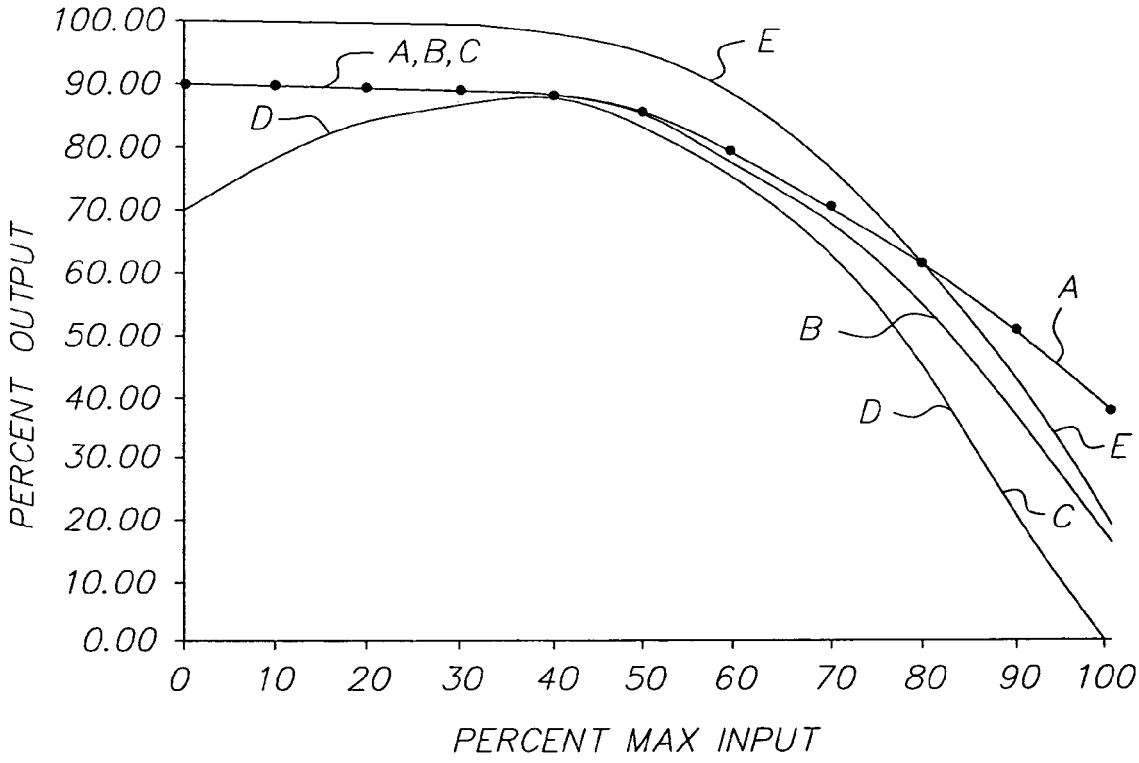
FIG. 6 are exemplary graphs illustrating amounts of clear toner to be deposited at pixel locations versus amounts of pigmented toner in a pentachrome image using an inverse mask for depositing the clear toner.
Figure 7A:
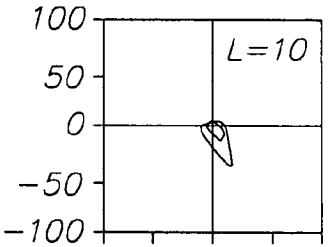
FIGS. 7A-7I are graphs illustrating a color gamut relationship between processing of a receiver sheet in accordance with four color processing as is known in the prior art vis-à-vis processing of a similar type of receiver sheet using a five color pentachrome processing with gloss enhancement in accordance with the invention, the outer area in each figure being the pentachrome image.
Figure 7B:
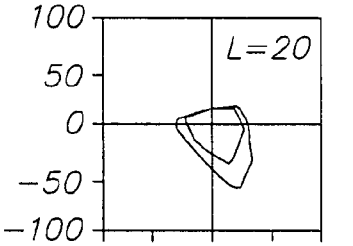
Figure 7C:
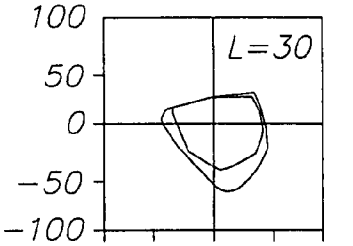
Figure 7D:
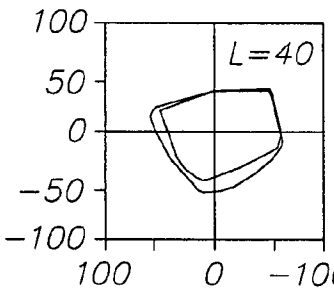
Figure 7E:
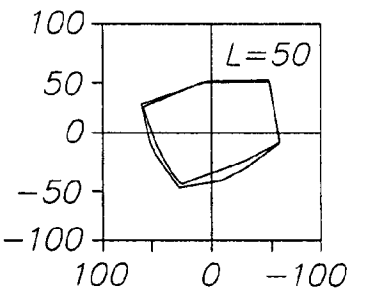
Figure 7F:
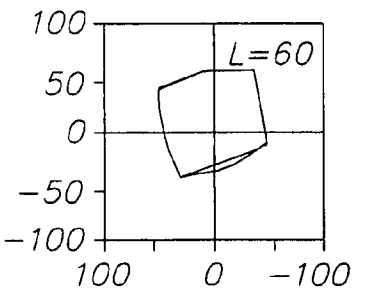
Figure 7G:
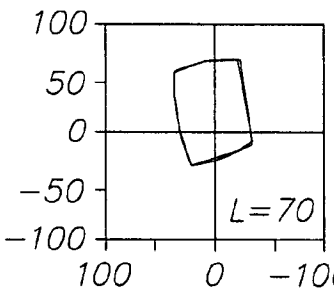
Figure 7H:
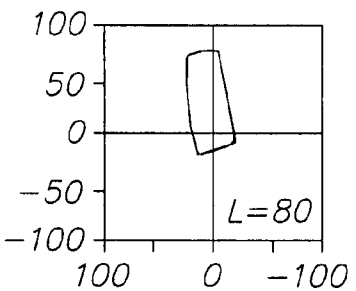
Figure 7I:
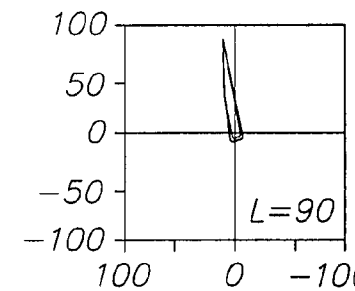

With continued reference to FIG. 5, incoming image data to be printed is input to the RIP 501 and converted to printer dependent color separation image data in each of the five color images printed by the printer apparatus 500. The clear toner image generator, which also may be a part of the RIP, creates a clear toner "image" from the five color separation images previously created as will be further described in more detail below and assuming that glossing is to be done during a second pass and an inverse mask is established for printing of the clear toner. Halftone screen generators or generators may also form a part of the RIP and convert each of the five color separation images into color separation halftone screened images. Additionally, the halftone screen generators may also convert the clear toner "image" into a halftone screen pattern (see dashed line) of image information, or alternatively (see full-line) the clear toner whether printed as an inverse mask or uniform overcoat may be established using continuous tone and not halftone printing. The image data from each of the four halftone screened color separation images and clear toner halftone screen separation image are output to frame buffers 502K, Y, M, C, and Red respectively from which they are sent to a printer host side interface. A printer board communicates with the printer host side interface and includes supporting circuitry for outputting corrected image information for printing by each of the respective writers 506 K, Y, M, C, and Red with appropriate synchronization. The clear toner (CT) image for IVM overcoat is determined as will be described below and printed during the second pass.

With reference now also to FIG. 6, an example of a general relationship between density of a color image at a particular pixel location or image area and a preferred amount of clear toner to be applied to the area as an inverse mask is shown. As may be noted from the graph "A" a 90% coverage level of clear toner or clear dry ink (CDI) is employed at pixel locations or image areas where color separation image percent is from 0% to 40%, i.e. the highlight region to the mid-tone region. For pixel locations or image areas where color separation image percent is greater than 40%, the mid-tone ranges through to the shadow region where toner buildup is greatest, there is a generally progressive decrease in percent of clear toner laid down with increases of color density or color separation image coverage. The generation of the "image" map for depositing the clear toner is generated for each pixel location for the clear toner "image." The generated image map, for the clear toner image, may be subjected to processing through a halftone screen generator or instead be of a continuous tone. The halftone screen generated image information for each the five color separation images and the image data for the clear toner image are modified to printer dependent image data and stored in frame buffers 502. The printer image data may also provide for correction for non-uniformities of the recording elements and/or other correction information or more preferably this can be provided on the printer board. In accordance with well-known techniques for printing the information stored in the frame buffers are output at suitably synchronized times for imaging of the respective electrostatic color separation images during the first pass and the clear toner image during the second pass by the respective writers as described above. As a convenience in calculation, rather than determining pigmented toner coverage at any pixel area in accordance with the sum of the five-color contributions at that pixel location, one may select the maximum contribution by a color at that pixel location as the percentage of pigmented toner coverage present at that location for use in determining the amount of clear toner overcoat to be applied in the inverse mask in accordance with the graph of FIG. 6. As a further convenience in calculation, in lieu of making such calculation for the inverse mask using a pixel by pixel calculation, one may group local areas of say 4×4 pixels or 16 pixels to determine the amount of clear toner in the inverse mask calculation for this small area formed by a group of pixels.

The specific IVM masks illustrated in FIG. 6 are merely exemplary. The IVM mask illustrated by curve "A" and described above may be referred to as a 90/90/40 mask illustrating the relationship from the highlight region to the mid-tone region and then with a gradual roll-off in the mid-tone region to the shadow region. The IVM mask illustrated by curve "B" may be referred to as a 90/90/20 IVM mask. The IVM mask illustrated by curve "C" may be referred to as a 90/90/00 IVM mask. The IVM mask illustrated by curve "D" may be referred to as a 70/90/00 IVM mask. This latter mask conserves clear toner use in the highlight region. Other IVM masks more suited to matte type receivers or uncoated receivers may have an IVM mask providing greater amounts of clear toner in the highlight area. For example, for such papers a 100/100/20 IVM mask (curve "E") might be used, it being understood that this refers to actual lay down of clear toner instead of differences in exposure setting for the writer that is used to "write" the clear toner image or inverse mask. The higher level for the IVM mask for the matte or uncoated receivers appears to provide for reduction of pinhole artifacts. The IVM mask curve may be optimized to reduce gamut loss and may be variable in accordance with substrate used for the receiver sheet or process stability or charge to mass (Q/M). In this regard wherein there is input or sensing of one more of factors including receiver type, electrostatographic process conditions including sensing of or determination of toner charge to mass, and toner type and in response selecting a suitable IVM mask in accordance with the appropriate conditions.

In an example of employing parameters suitable for an application of the invention, a Sappi Lustro Gloss 216 paper receiver has a glossy coating thereon. The paper weight is 216 g/m2, Sheffield smoothness of 16, an IVM mask of 90/90/00 may be used, a fuser temperature of 163° C. may be used, a reduced fuser nip pressure, that creates a nip width of 14 mm may be used, a fuser nip energy flow of 2064 joules may be used, a glosser temperature of 160° C. may be used, a glosser nip pressure that creates a nip width of 13 may be used. When no clear toner overcoat is provided for this paper and no treatment by the glosser, the color image formed thereon might be fuser processed with a fuser temperature similarly of 163° C., a fuser nip pressure that creates a nip width of 20 mm which would be considered nominal for this receiver (which is higher than the reduced fusing pressure applied to the pentachrome image before application of the clear toner IVM mask embodiment), a fuser energy flow for the non-clear toner coated embodiment of 2264 joules-which is also higher than the reduced fusing condition where the pentachrome image is formed before application of the clear toner IVM mask embodiment.

The invention thus provides for the use of an inverse mask mode with a pentachrome color image. Balance is created in toner stack heights by providing relatively greater amounts of clear toner coverage to areas of an image having relatively lower amounts of color toner coverage and lesser amounts of clear toner coverage to areas of the image having relatively greater amounts of color toner coverage. Differential gloss is reduced. The controller of the printer, which preferably includes a computer, may be programmed so as to be operative, for example by selection by the operator, to process the printing of an image in accordance with anyone of the three selectable modes so that some prints may be formed that are uniformly covered with clear toner, other prints may be formed in accordance with the aforesaid third mode wherein back-transfer artifacts are reduced or eliminated wherein less than five colors are used to produce a multicolor image in a five color station tandem printer and without the need to and expense of providing uniform coverage of clear toner to the print and still other prints may be formed in accordance with the noted second mode wherein balance is achieved in toner stack heights using the inverse mask in a pentachrome color image.

In FIG. 7*a-i* there is illustrated a comparison of color gamuts in various L* slices in a*, b* space of a four-color single pass CMYK color printed image versus a five color CMYK plus Blue color printed image formed in a single pass and provided with a clear toner overcoat in a second pass and then finished with the belt glosser. There appears to be an increase in color gamut in the blue region and high gloss (G20 of 90 value) can be achieved with medium gloss paper (paper gloss about 35 with G60 measurement).

Although the invention has been described in terms of a two pass system, the first pass providing the pentachrome color image and the second pass involving disablement of the first four color stations and the provision of a clear toner overcoat to the pentachrome image and then glossing the clear toner overcoated image, it will be understood that the glossing apparatus may be provided with a clear toner applicator located at the output of the fusing station of the printer apparatus of FIG. 1. Additional color stations may be provided in the printer apparatus to form multicolor images having more than five colors and thus the printer apparatus may be said to be adapted to form at least a pentachrome color image. In addition the at least pentachrome color images may be formed using inkjet, thermal or other printing technology instead of electrostatographic reproduction as described herein.

In an alternative embodiment of the invention the glosser itself may have a clear dry ink toner toning station before the belt finishing station. In such an example a finished pentachrome image with enhanced gloss can be provided in a single pass by forming the pentachrome image in the printing apparatus 100 and subjecting the pentachrome image to a fusing step by passing the receiver within the fusing rollers and subjecting the receiver with the pentachrome image formed thereon to heat and pressure to fuse the pentachrome toner image to the receiver and subsequent to such fusing passing the fused pentachrome toner image to a glossing station having a clear toner overcoating station so that the clear toner is applied over the fused pentachrome toner image either as a uniform overcoat or as an inverse mask applied overcoat and then subjecting the overcoated pentachrome toner image to gloss enhancement in the belt glosser. In this regard, reference may be made to the apparatus shown in FIG. 8.

In accordance with the invention, an at least pentachrome image comprises an image formed from at least five distinct color ink pigments that combine to form a color gamut. Examples of such pigmented combinations forming a pentachrome image, and which examples should not be considered limiting, include CMYK+Red, CMYK+Blue, CMYK+Green, CMYK+Orange, CMYK+Violet, and CMYK+Red+Blue+Green.

Still other alternatives contemplated by the invention include substituting the black toner used in one of the toner printing modules or printing stations of printer apparatus 100 with toner of another color so that pentachrome color images may be formed from five colors such as cyan, magenta, yellow, red and blue in a first or single pass. This allows for even further expansion of color gamut. Subsequent to fusing of the image formed from five color pigments (CMY, Red, Blue) the clear dry toner ink may be applied either in a uniform overcoat or inverse mask application in a second pass through the color printer apparatus 100 having the clear toner substituted for the pigmented toner in the last color station with disablement of the printing stations or modules upstream. Where the inverse mask is used, the mask may be in relation to the cyan, magenta and yellow (CMY) toner amounts at respective pixel locations.

In still other alternatives, the pentachrome color image having another color, such as blue or green, substituted for black may be sent in a first pass subsequent to fusing to a toning station having the clear toner such as the glosser which includes a clear toner precoater and then subjected to enhanced glossing by passing through the belt glosser. This provides for single pass pentachrome color images with enhanced color gamut and gloss enhancement.

Figure 8:
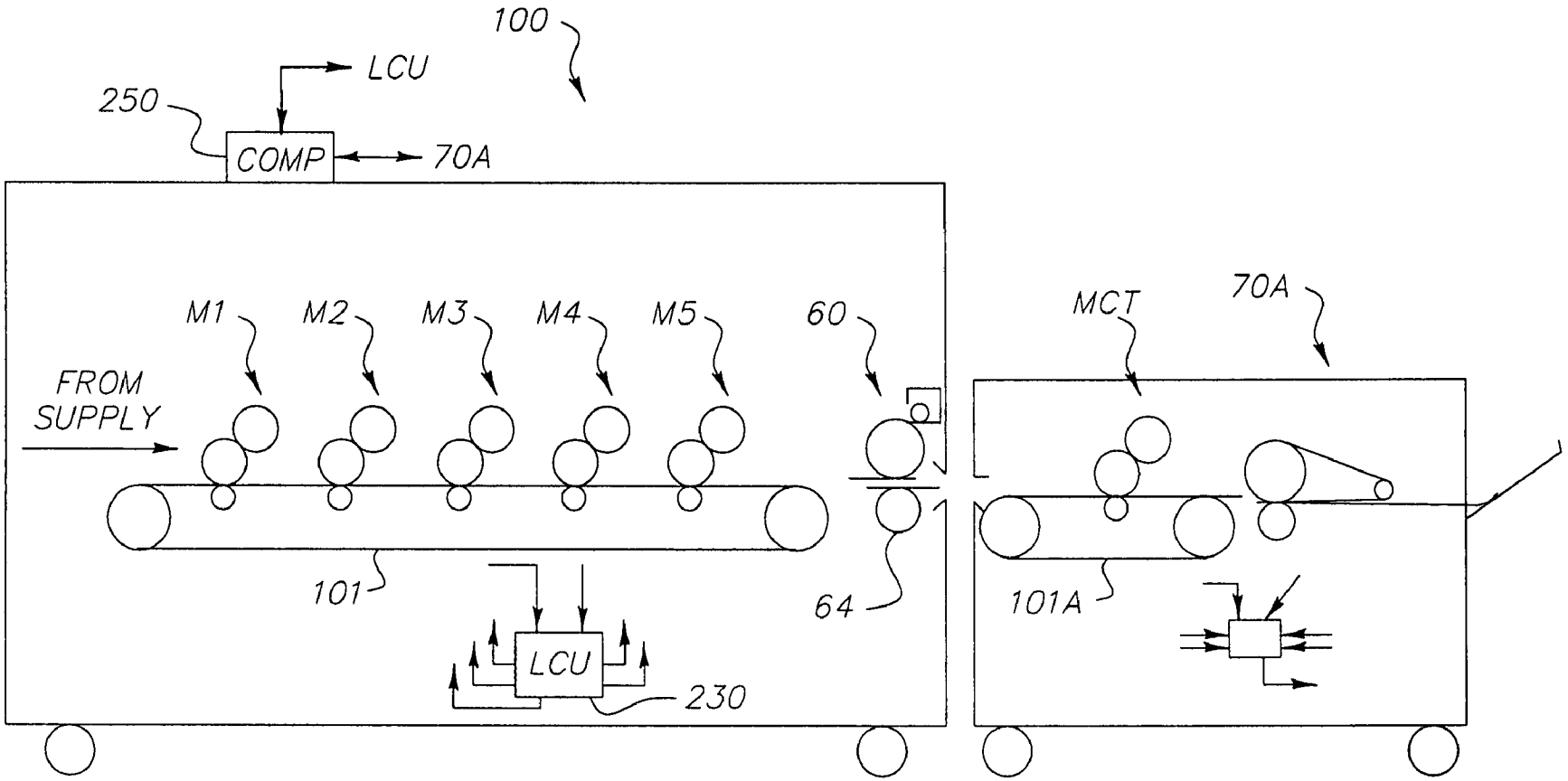
FIG. 8 is a schematic of an alternative embodiment of the invention.

With reference to the alternative embodiment illustrated in FIG. 8, a five module electrostatographic printer apparatus similar to that described above with reference to FIGS. 1A and 1B is positioned adjacent a gloss enhancement apparatus 70A. The printing modules M1-M5 are provided with respective different color toners to provide a pentachrome color image on a receiver sheet passing through the printing stations while being supported on the transport belt or web 101. The description above relative to the printer apparatus 100 and the different combinations of toner colors employed to create a printed pentachrome image are pertinent to the description of the embodiment of FIG. 8. After creation of the pentachrome image on the receiver sheet, the receiver sheet enters the fusing station 60 and the pentachrome image is fused to the receiver sheet as it exits the printer apparatus 100. The gloss enhancement apparatus 70A includes a clear toner-printing module MCT that may be similar to one of the modules M1-M5. A computer controller 250 may receive image data from a network or terminal or other image data input device and input this data to the printer apparatus 100 and to the clear toner printing module MCT for creation of an inverse mask in accordance with signals sent from this terminal to a controller associated with the gloss enhancement apparatus 70A. Alternatively, the clear toner-printing module may be used to provide a uniform overcoat layer to the pentachrome image. Whether the clear toner printing module MCT prints an inverse mask clear toner overcoat or provides a uniform clear toner overcoat, the characteristics of this clear toner overcoat may be adjusted for the type of receiver as has been described above. In this regard memory in one or more of the controllers may contain tables providing fusing and clear toner characteristics to be provided for possible receivers to be processed by the printer apparatus 100 and the gloss enhancement apparatus 70A. Where the gloss enhancement apparatus 70A only provides for a generally uniform clear toner overcoat, the nature of the printer apparatus may be simplified such as by eliminating the electro-optical writer and providing for clear toner overcoats through control of the development station or providing some other uniform toner coating device. Subsequent to placement of the clear toner overcoat upon the pentachrome print by the module MCT, the coated pentachrome print then enters the glosser as described above for gloss enhancement treatment.

As noted above for certain receiver members, such as relatively rough papers, the fusing conditions in the first pass for fusing the pentachrome image may be substantially similar to the fusing conditions for fusing when the receiver member with the clear toner overcoat and the fused pentachrome image is passed through the fusing rollers in a second pass.

A uniform overcoat of clear toner can be optimized for different receiver substrates; for example, a 70% overall coverage for very smooth paper (Sheffield smoothness between about 10-15), versus a 90% to 100% coverage for a slightly rougher paper (Sheffield smoothness about 40-70). The provision of a uniform clear toner overcoat is simpler to perform than using the inverse mask although the IVM does save on the usage of clear toner. It is desirable to have clear toner on low-pigmented toner coverage or highlight areas to prevent offset of the color toners to the belt glosser. The clear toner may be deposited in accordance with a continuous tone or a halftone.

There has thus been shown an improved printer apparatus and method of printing wherein color images with improved color gamut may be printed with minimization of artifacts such as differential gloss, provided for through selective depositing of clear toner to the image.

The invention has been described in detail with particular reference to certain preferred embodiments thereof, but it will be understood that variations and modifications can be effected within the spirit and scope of the invention.

The invention claimed is:

1. A method of printing to form colored images with improved color gamut and enhanced gloss, the method comprising:

forming a color print using five or more different color pigments which in combination form at least a pentachrome color image;

depositing a clear toner overcoat to the at least pentachrome color image, wherein the clear toner overcoat is formed as a receiver and image dependent inverse mask; and subjecting the clear toner overcoat and the at least pentachrome color image to a gloss enhancing process.

2. The method of claim 1 and wherein the at least pentachrome color image is formed in an electrostatographic printing process and is fused before application of the clear toner overcoat thereupon.

3. The method of claim 1 and wherein the color image is a pentachrome color image and the pentachrome color image is formed in a single pass though a printer apparatus.

4. The method of claim 3 and wherein the clear toner overcoat is formed in a second pass though the apparatus that forms the pentachrome color image.

5. A method of printing to form colored images with improved color gamut and enhanced gloss, the method comprising:

forming a color print using five or more different color pigments which in combination form at least a pentachrome color image, wherein the at least pentachrome color image is formed in a single pass through a printer apparatus;

depositing a clear toner overcoat to the at least pentachrome color image, wherein the clear toner overcoat is formed as a receiver and image dependent inverse mask; and subjecting the clear toner overcoat and the at least pentachrome color image to a uniform gloss enhancing process.

6. The method of a claim 5 and wherein the clear toner overcoat is adjusted in accordance with characteristics of a receiver member.

* * * * *

UNITED STATES PATENT AND TRADEMARK OFFICE

CERTIFICATE OF CORRECTION

PATENT NO. : 7,502,582 B2
APPLICATION NO. : 11/021119
DATED : March 10, 2009
INVENTOR(S) : Yee S. Ng et al.

It is certified that error appears in the above-identified patent and that said Letters Patent is hereby corrected as shown below:

| | |
|---|---|
| Column 14, line 24 | In Claim 3, delete "though" and insert -- through --, therefor. |
| Column 14, line 26 | In Claim 4, delete "though" and insert -- through --, therefor. |
| Column 14, line 42 | In Claim 6, after "of" delete "a". |

Signed and Sealed this

Twelfth Day of January, 2010

David J. Kappos

David J. Kappos
*Director of the United States Patent and Trademark Office*